US005534400A

United States Patent [19]

Hirabayashi et al.

[11] Patent Number: 5,534,400

[45] Date of Patent: Jul. 9, 1996

[54] SILVER HALIDE COLOR PHOTOGRAPHIC LIGHT-SENSITIVE MATERIAL

[75] Inventors: Shigeto Hirabayashi; Shuichi Sugita, both of Hino, Japan

[73] Assignee: Konica Corporation, Tokyo, Japan

[21] Appl. No.: 368,880

[22] Filed: Jan. 5, 1995

Related U.S. Application Data

[63] Continuation-in-part of Ser. No. 109,533, Aug. 20, 1993, abandoned.

[30] Foreign Application Priority Data

Aug. 24, 1992 [JP] Japan ..... 4-245936
Aug. 24, 1992 [JP] Japan ..... 4-245937

[51] Int. Cl.[6] ..... G03C 1/08; G03C 7/26; G03C 7/32

[52] U.S. Cl. ..... 430/558; 430/503; 430/543

[58] Field of Search ..... 430/503, 508, 430/558, 543

[56] References Cited

U.S. PATENT DOCUMENTS

| | | | |
|---|---|---|---|
| 3,725,067 | 4/1973 | Bailey et al. | 430/476 |
| 3,758,309 | 9/1973 | Bailey et al. | 430/587 |
| 3,810,761 | 5/1974 | Bailey et al. | 430/522 |
| 4,840,886 | 6/1989 | Iijima et al. | 430/558 |
| 4,973,546 | 11/1990 | Kaneko et al. | 430/558 |
| 5,208,140 | 5/1993 | Nishijima | 430/558 |

FOREIGN PATENT DOCUMENTS

| | | |
|---|---|---|
| 0206461 | 12/1986 | European Pat. Off. . |
| 0240852 | 10/1987 | European Pat. Off. . |

*Primary Examiner*—Geraldine Letscher
*Attorney, Agent, or Firm*—Finnegan, Henderson, Farabow, Garrett & Dunner

[57] ABSTRACT

A silver halide color photographic light-sensitive material comprises a green-sensitive silver halide emulsion layer containing a magenta coupler is disclosed. The magenta coupler is represented by a coupler of a formula:

In the formulae R represents a primary alkyl group having 5 or more carbon atoms; X represents a hydrogen atom or a substituent which splits off upon reaction with the oxidation product of a color developing agent; Z represents a group of non-metal atoms necessary to form a nitrogen-containing heterocyclic ring; $R_{21}$ represents an alkylene or alkenylene group having a primary carbon atom bound directly to Z; $R_{22}$ represents an alkyl group.

5 Claims, No Drawings

SILVER HALIDE COLOR PHOTOGRAPHIC LIGHT-SENSITIVE MATERIAL

This is a C.I.P application of Ser. No. 08/109,533 filed on Aug. 20, 1993, now abandoned.

FIELD OF THE INVENTION

The present invention relates to a silver halide color photographic light-sensitive material which has high sensitivity, excellent printer-to-printer fluctuation and good unprocessed sample storage stability.

BACKGROUND OF THE INVENTION

The silver halide color photographic light sensitive material normally incorporates a combination of yellow, magenta and cyan couplers. Widely used magenta couplers are 5-pyrazolone series magenta couplers. Because of secondary absorption near 430 run shown by the dye formed upon developing, 5-pyrazolone series magenta couplers pose various problems in color reproduction. In an attempt to solve these problems, researchers have studied new magenta couplers, resulting in the development of pyrazolotriazole series couplers such as those disclosed in U.S. Pat. Nos. 3,725,065, 3,810,761, 3,758,309 and 3,725,067.

These couplers have a number of advantages, including little secondary absorption, which is advantageous for color reproducibility, and excellent storage stability in the presence of formalin.

However, pyrazolotriazole series couplers are less sensitive than conventional 5-pyrazolone series magenta couplers because of their self-suppressing property. They have another drawback of coated sample sensitivity reduction during storage under high-temperature high-humidity conditions.

Sill another drawback is hue discrepancy on finished color printing paper among different printing machines (hereinafter referred to as printers) used to print a color negative film on the printing paper.

This phenomenon is assumed to occur mainly for the following reasons. In printing color printing paper from a color negative film using a printer, the printer first (1) measures the blue, green and red densities of the color negative film, then (2) converts these measurements to color printing paper exposure amounts, and (3) exposes the color printing paper with that exposure amount. Various printers are commercially available; the spectral sensitivity of the detector used in the light measurement process of (1) above can vary among types of these printers. Also, hue discrepancy can occur, in association with the spectral absorption properties of the coloring dyes in the color negative film, for example, due to insufficient half-value width or spectral absorption property fluctuation with concentration change. Some of the above-described pyrazolotriazole series magenta couplers show wide spectral absorption property fluctuation with concentration change, which is assumed to be a major cause of the wide printer-to-printer fluctuation.

The other problem is that the photographic characteristics given by the magenta coupler sometimes varies following to the change of processing condition, for example, pH variation of developing liquid.

For this reason, there has been a need for the development of a silver halide color photographic light-sensitive material containing a pyrazolotriazole series magenta coupler and having high sensitivity, excellent storage stability, reduced printer-to-printer fluctuation and improved stability against the change of processing condition.

SUMMARY OF THE INVENTION

The object of the present invention is to provide a silver halide photographic light-sensitive material having high sensitivity, excellent unprocessed sample storage stability, reduced printer-to-printer fluctuation and stability against processing condition.

A silver halide color photographic light-sensitive material of the invention comprises a blue-sensitive silver halide emulsion layer, a green-sensitive silver halide emulsion layer and a red-sensitive silver halide emulsion layer, wherein at least one green-sensitive silver halide emulsion layer contains a coupler of the formula M-XI:

M-XI

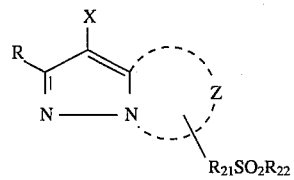

wherein R represents a primary alkyl group having 5 or more carbon atoms; X represents a hydrogen atom or a substituent which splits off upon reaction with the oxidation product of a color developing agent; Z represents a group of non-metal atoms necessary to form a nitrogen-containing heterocyclic ring; $R_{21}$ represents an alkylene or alkenylene group having a primary carbon atom bound directly to Z; $R_{22}$ represents an alkyl group.

DETAIL DISCLOSURE OF THE INVENTION

The primary alkyl group for R having 5 or more carbon atoms is exemplified by a pentyl group, a hexyl group, an octyl group, a dodecyl group, a tetradecyl group, a pentadecyl group and a hexadecyl group. Of these groups are preferred primary alkyl groups having 5 to 15 carbon atoms.

The alkenyl group represented by $R_{22}$ is preferably one having 2 to 32 carbon atoms, preferably more than 8 carbon atoms, whether linear or branched. $R_{22}$ is preferably a branched alkyl.

The cycloalkyl group represented by $R_{22}$ is preferably a 5- or 6-membered ring.

The alkylene group represented by $R_{21}$ is preferably one having 1 to 32 carbon atoms, more preferably 1 to 3 carbon atoms.

The alkenylene group represented by $R_{21}$ is preferably one having 3 to 32 carbon atoms, more preferably 3 to 6 carbon atoms.

The groups represented by $R_{21}$ and $R_{22}$ may each have an additional substituent. This substituent is exemplified by alkyl groups, cycloalkyl groups, alkenyl groups, aryl groups, acylamino groups, sulfonamide groups, alkylthio groups, arylthio groups, halogen atoms, heterocyclic rings, sulfonyl groups, sulfinyl groups, phosphonyl groups, acyl groups, carbamoyl groups, sulfamoyl groups, cyano groups, alkoxy groups, aryloxy groups, heterocyclic oxy groups, siloxy groups, acyloxy groups, carbamoyloxy groups, amino groups, alkylamino groups, imide groups, ureide groups, sulfamoylamino groups, alkoxycarbonylamino groups, aryloxycarbonylamino groups, alkoxycarbonyl groups and hydroxycarbonyl groups.

The preferable example of $R_{21}$ has not a substituent. The preferable example of $R_{22}$ has not a substituent.

The coupler represented by formula M-XI is more specifically represented by, for example, the following formulas M-XII through M-XIV.

M-XII

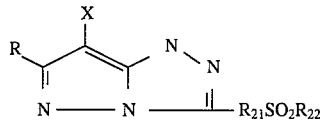

M-XIII

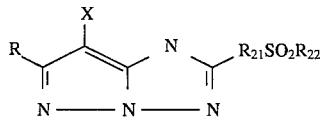

-continued

M-XIV

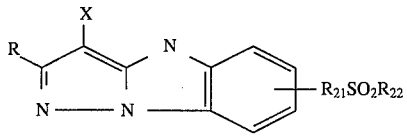

In the formulas M-XII through M-XIV, R, $R_{21}$, $R_{22}$ and X represent the same groups as R, $R_{21}$, $R_{22}$ and X in formula M-XI, respectively.

Examples of the magenta coupler are given below.

(1)

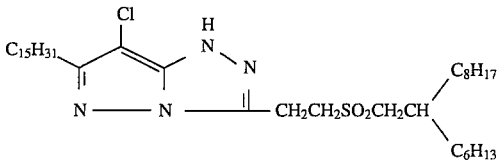

(2)

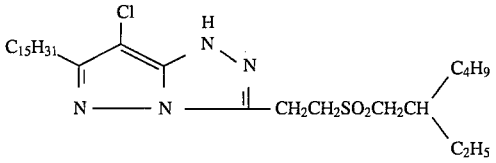

(3)

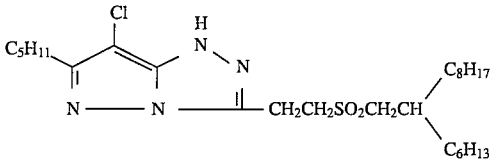

(4)

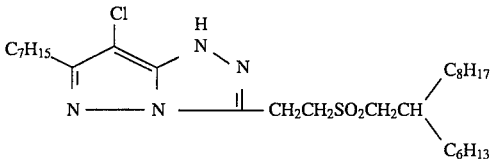

(5)

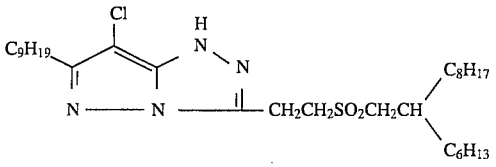

(6)

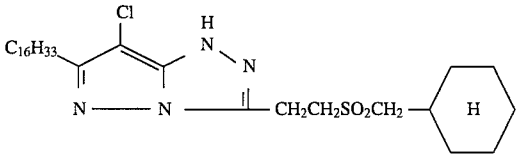

(7)

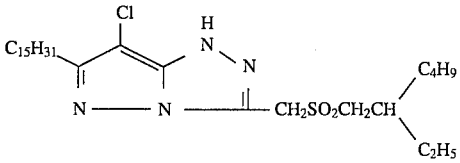

-continued
(8)
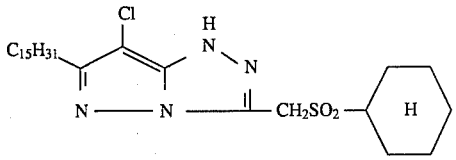
(9)
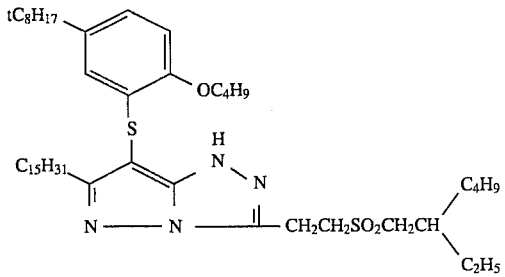
(10)
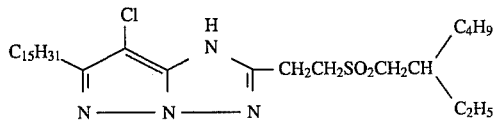
(11)
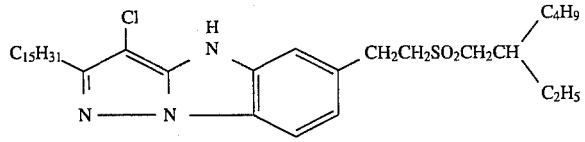
(12)
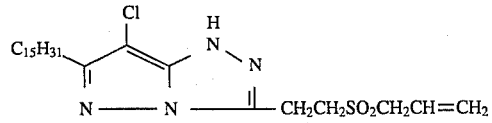
(13)
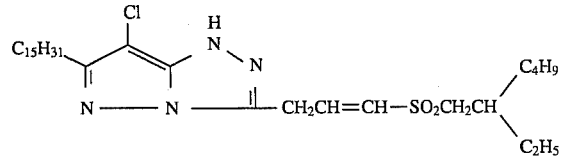
Example Compound 1
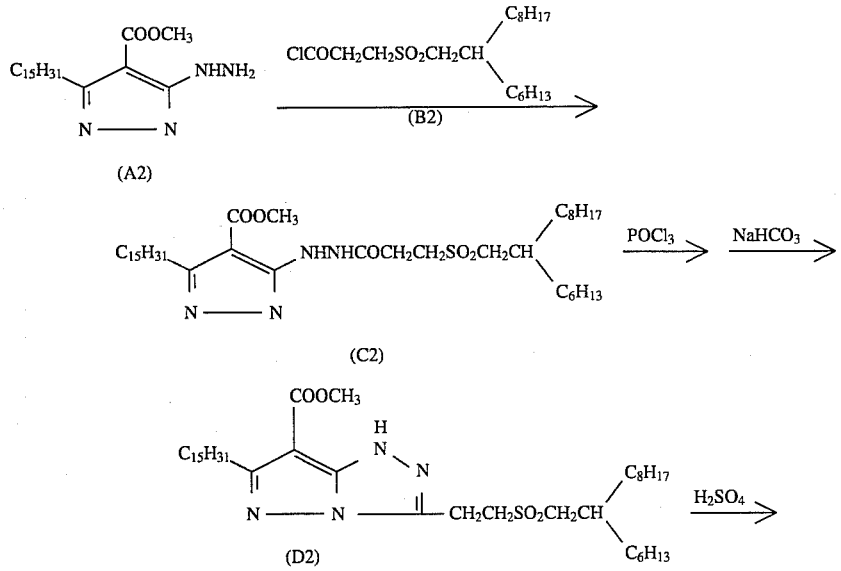

-continued

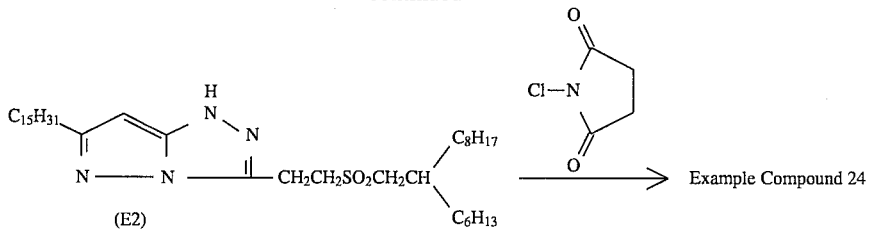

Synthesis of Compound C2

To 300 ml of ethyl acetate were added 30 g of Compound A2 and 100 ml of a 15% aqueous potassium acetate solution, followed by dropwise addition of 38 g of Compound B2 over a period of 15 minutes and subsequent stirring at 40° to 60° C. for 1 hour. After the reaction mixture was cooled, the water layer was removed, followed by washing with dilute hydrochloric acid and then with water. After the ethyl acetate was removed under reduced pressure, the residue was recrystallized from methanol to yield 56 g (yield 96%) of Compound C2.

Synthesis of Compound D2

To a solution of 56 g of Compound A2 in 300 ml of toluene was added 12 ml of phosphorus oxychloride, followed by heating and refluxing for 3 hours. After the reaction mixture was cooled, 300 ml of ethyl acetate was added. After this mixture was washed with 100 ml of water, 7% potassium hydrogen carbonate was added, followed by heating and refluxing for 1 hour. After cooling, the reaction mixture was washed with 100 ml of water, followed by reaction solvent removal by distillation under reduced pressure, to yield 54 g (yield 89%) of Compound D2.

Synthesis of Compound E

To 60 ml of a 50% aqueous acetic acid solution was added 30 ml of sulfuric acid, followed by addition of 54 g of Compound D2 and subsequent heating and refluxing for 10 hours. After the reaction mixture was poured over 300 ml of ice water, the resulting crystal was collected by filtration and dried, to yield 34 g (yield 69%) of Compound E2.

Synthesis of Example Compound 24

34 g of Compound E2 was dissolved in 250 ml of ethyl acetate, and 7.1 g of N-chlorosuccinimide was added over a period of 30 minutes at room temperature. The reaction mixture was washed with water, and the solvent was removed by distillation under reduced pressure, followed by recrystallization from 100 ml of hexane, to yield 21 g (yield 58.6%) of Example Compound 24.

The magenta coupler of the present invention, represented by formula M-I, can be used within the range from $1\times10^{-3}$ to $8\times10^{-1}$ mol, preferably $1\times10^{-2}$ to $8\times10^{-1}$ mol per mol of silver halide.

The magenta coupler can be used in combination with other kinds of magenta couplers.

To incorporate the magenta coupler, conventional methods can be used, that is, the method wherein one or more kinds of the magenta coupler, whether singly or in combination, are dissolved in a mixture of a high boiling solvent such as dibutyl phthalate or tricresyl phosphate and a low boiling solvent such as butyl acetate or ethyl acetate or to a low boiling solvent alone, after which the solution is mixed with an aqueous gelatin solution containing a surfactant, this mixture is then emulsified and dispersed using a high speed rotary mixer, a colloid mill or an ultrasonic disperser, and the resulting dispersion is added directly to an emulsion. It is also possible to prepare the above emulsion dispersion and then cut it finely, wash it with water and then add it to an emulsion.

The magenta coupler may be added to a silver halide emulsion as a dispersion separate from the high boiling solvent dispersion. It is preferable to simultaneously dissolve, disperse and add both compounds to the emulsion.

The amount of the high boiling solvent added is preferably 0.01 to 10 g, more preferably 0.1 to 3.0 g per gram of the magenta coupler.

A conventional silver halide emulsion can be used in the light-sensitive material of the present invention. The emulsion may be chemically sensitized by a conventional method, and may also be optically sensitized with sensitizing dyes in the desired wavelength band.

The silver halide emulsion may incorporate an antifogging agent, a stabilizer and other additives. It is advantageous to use gelatin as a binder for the emulsion.

Emulsion layers and other hydrophilic colloidal layers may be hardened, and may incorporate a plasticizer and a dispersion (latex) of a water-insoluble or sparingly water-soluble synthetic polymer. The emulsion layers of a color photographic light-sensitive material incorporate couplers.

It is also possible to use colored couplers having a color correcting effect, competitive couplers, and compounds which release photographically useful fragments such as a developing accelerator, a bleaching accelerator, a developing agent, a silver halide solvent, a toning agent, a hardener, a fogging agent, an antifogging agent, a chemical sensitizer, a spectral sensitizer and a desensitizer upon coupling reaction with the oxidation product of a developing agent.

Materials which can be used as the support include paper laminated with polyethylene etc., polyethylene terephthalate films, baryta paper and triacetyl cellulose films.

To obtain a dye image using the light-sensitive material of the present invention, exposure is followed by an ordinary color photographic process.

EXAMPLES

In all examples given below, the amount of addition in silver halide photographic light-sensitive material is expressed in gram per $m^2$, unless otherwise stated. The figures for silver halide and colloidal silver have been converted to the amounts of silver.

Example 1

Layers of the following compositions were formed on a triacetyl cellulose film support in this order from the support side to prepare a multiple-layered color photographic light-sensitive material (sample No. 1).

| Layer 1: Anti-halation layer HC-1 | |
|---|---|
| Black colloidal silver | 0.20 |
| UV absorbent UV-1 | 0.20 |
| Colored coupler CC-1 | 0.05 |
| Colored coupler CM-1 | 0.05 |

-continued

| | |
|---|---|
| High boiling solvent Oil-1 | 0.20 |
| Gelatin | 1.5 |
| Layer 2: First interlayer IL-1 | |
| UV absorbent UV-1 | 0.01 |
| High boiling solvent Oil-1 | 0.01 |
| Gelatin | 1.5 |
| Layer 3: Low speed red-sensitive emulsion layer RL | |
| Silver iodobromide emulsion Em-1 | 0.8 |
| Silver iodobromide emulsion Em-2 | 0.8 |
| Sensitizing dye SD-1 | $2.5 \times 10^{-4}$ (mol/mol silver) |
| Sensitizing dye SD-2 | $2.5 \times 10^{-4}$ (mol/mol silver) |
| Sensitizing dye SD-3 | $0.5 \times 10^{-4}$ (mol/mol silver) |
| Cyan coupler C-1 | 1.0 |
| Colored cyan coupler CC-1 | 0.05 |
| DIR compound D-1 | 0.002 |
| High boiling solvent Oil-1 | 0.5 |
| Gelatin | 1.5 |
| Layer 4: High speed red-sensitive emulsion layer RH | |
| Silver iodobromide emulsion Em-3 | 2.0 |
| Sensitizing dye SD-1 | $2.0 \times 10^{-4}$ (mol/mol silver) |
| Sensitizing dye SD-2 | $2.0 \times 10^{-4}$ (mol/mol silver) |
| Sensitizing dye SD-3 | $0.1 \times 10^{-4}$ (mol/mol silver) |
| Cyan coupler C-1 | 0.25 |
| Cyan coupler C-2 | 0.05 |
| Colored cyan coupler CC-1 | 0.015 |
| DIR compound D-1 | 0.05 |
| High boiling solvent Oil-1 | 0.2 |
| Gelatin | 1.5 |
| Layer 5: Second interlayer IL-2 | |
| Gelatin | 0.5 |
| Layer 6: Low speed green-sensitive emulsion layer GL | |
| Silver iodobromide emulsion Em-1 | 1.3 |
| Sensitizing dye SD-4 | $5 \times 10^{-4}$ (mol/mol silver) |
| Sensitizing dye SD-5 | $1 \times 10^{-4}$ (mol/mol silver) |
| Magenta coupler M-A | 0.25 |
| Magenta coupler M-B | 0.25 |
| Colored magenta coupler CM-1 | 0.01 |
| DIR compound D-3 | 0.02 |
| DIR compound D-4 | 0.020 |
| High boiling solvent Oil-2 | 0.3 |
| Gelatin | 1.0 |
| Layer 7: High speed green-sensitive emulsion layer GH | |
| Silver iodobromide emulsion Em-3 | 1.3 |
| Sensitizing dye SD-6 | $1.5 \times 10^{-4}$ (mol/mol silver) |
| Sensitizing dye SD-7 | $2.5 \times 10^{-4}$ (mol/mol silver) |
| Sensitizing dye SD-8 | $0.5 \times 10^{-4}$ (mol/mol silver) |
| Magenta coupler M-A | 0.05 |
| Magenta coupler M-B | 0.10 |
| Colored magenta coupler CM-2 | 0.05 |
| DIR compound D-3 | 0.01 |
| High boiling solvent Oil-2 | 0.2 |
| Gelatin | 1.0 |
| Layer 8: Yellow filter layer YC | |
| Yellow colloidal silver | 0.1 |
| Antistaining agent SC-1 | 0.1 |
| High boiling solvent Oil-3 | 0.1 |
| Gelatin | 0.8 |
| Layer 9: Low speed blue-sensitive emulsion layer BL | |
| Silver iodobromide emulsion Em-1 | 0.25 |
| Silver iodobromide emulsion Em-2 | 0.25 |
| Sensitizing dye SD-10 | $7 \times 10^{-4}$ (mol/mol silver) |

-continued

| | |
|---|---|
| Yellow coupler Y-1 | 0.5 |
| Yellow coupler Y-2 | 0.1 |
| DIR compound D-2 | 0.01 |
| High boiling solvent Oil-2 | 0.3 |
| Gelatin | 1.0 |
| Layer 10: High speed blue-sensitive emulsion layer BH | |
| Silver iodobromide emulsion Em-4 | 0.4 |
| Silver iodobromide emulsion Em-1 | 0.4 |
| Sensitizing dye SD-9 | $1 \times 10^{-4}$ (mol/mol silver) |
| Sensitizing dye SD-10 | $3 \times 10^{-4}$ (mol/mol silver) |
| Yellow coupler Y-1 | 0.30 |
| Yellow coupler Y-2 | 0.05 |
| High boiling solvent Oil-2 | 0.15 |
| Gelatin | 1.1 |
| Layer 11: First protective layer Pro-1 | |
| Fine silver iodobromide grain emulsion (an average grain size of 0.08 μm, an AgI content of 2 mol %) | 0.4 |
| UV absorbent UV-1 | 0.10 |
| UV absorbent UV-2 | 0.05 |
| High boiling solvent Oil-1 | 0.1 |
| High boiling solvent Oil-3 | 0.1 |
| Formalin scavenger HS-1 | 0.5 |
| Formalin scavenger HS-2 | 0.2 |
| Gelatin | 1.0 |
| Layer 12: Second protective layer Pro-2 | |
| Surfactant Su-1 | 0.005 |
| Alkali-soluble matting agent having an average grain size of 2 μm | 0.05 |
| Polymethyl methacrylate having an average grain size of 3 μm | 0.05 |
| Lubricant (WAX-1) | 0.04 |
| Gelatin | 0.6 |

In addition to these compositions, a coating aid Su-2, a dispersing agent Su-3, hardeners H-1 and H-2, a stabilizer ST-and antifogging agents AF-1 and AF-2 were added to appropriate layers. Em-1: Monodispersed (distribution width 14%) core/shell emulsion comprising grains having a low surface silver iodide content (2 mol%), an average grain size of 0.46 μm and an average silver iodide content of 7.0 mol%.

Em-2: Monodispersed (distribution width 14%) core/shell emulsion comprising grains containing surface silver bromide and having an average grain size of 0.30 μm and an average silver iodide content of 2.0 mol%.

Em-3: Monodispersed (distribution width 14%) core/shell emulsion comprising grains having a low surface silver iodide content (1.0 mol%), an average grain size of 0.81 μm and an average silver iodide content of 7.0 mol%.

Em-4: Monodispersed (distribution width 14%) core/shell emulsion comprising grains having a low surface silver iodide content (0.5 mol%), an average grain size of 0.95 μm and an average silver iodide content of 8.0 mol%.

Distribution width=standard deviation/average grain size×100

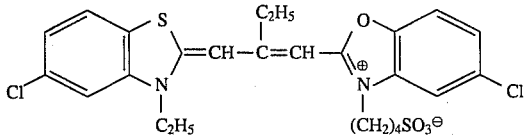

SD-1

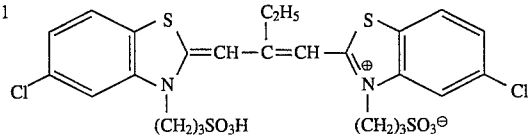

SD-2

-continued
SD-3
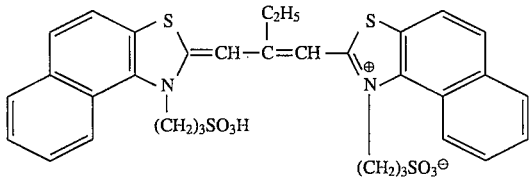
SD-4
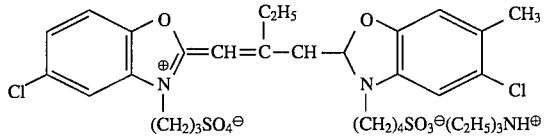
SD-5
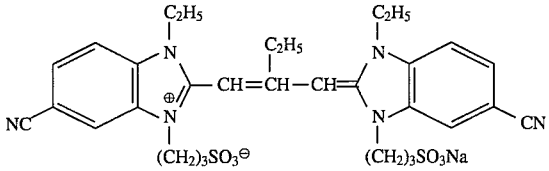
SD-6
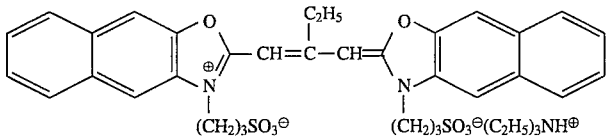
SD-7
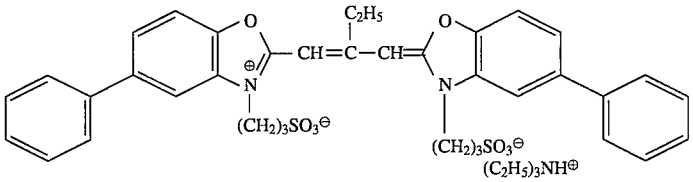
SD-8
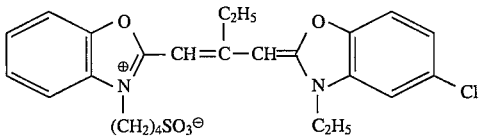
SD-9
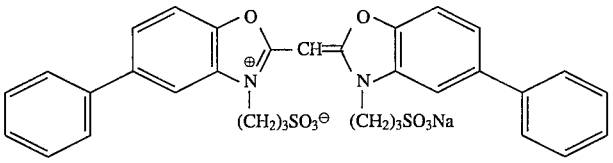
SD-10
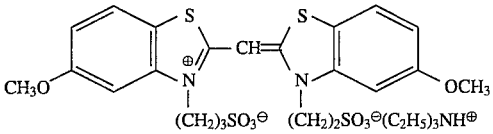
C-1
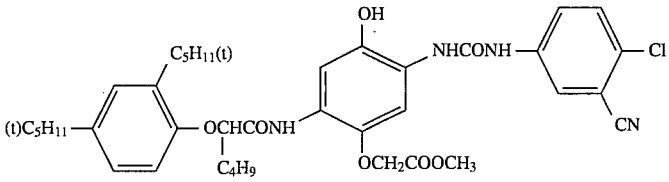

-continued
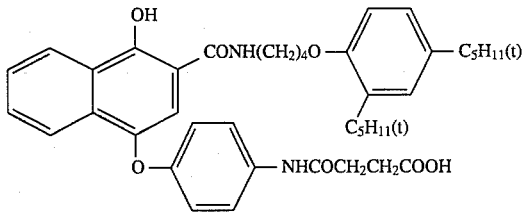
(Comparative Coupler)
M-A
C-2 (Comparative Coupler)
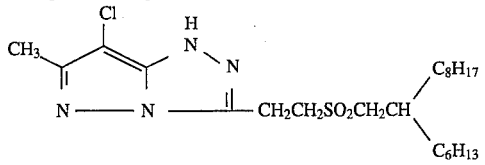
M-B
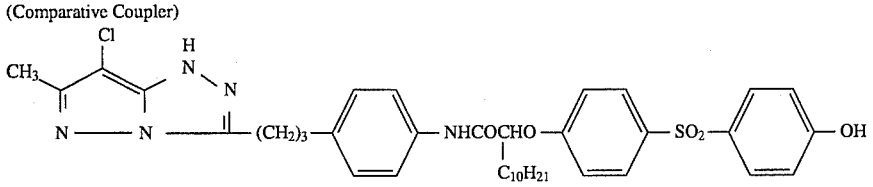
Y-1
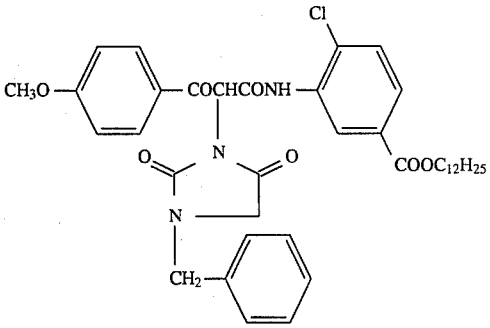
Y-2
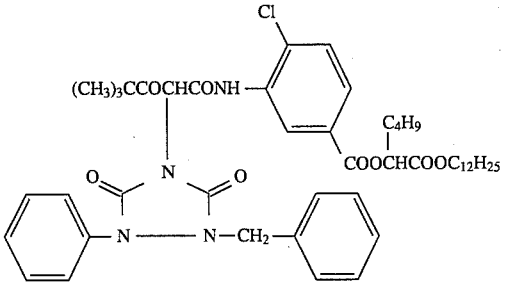
CC-1
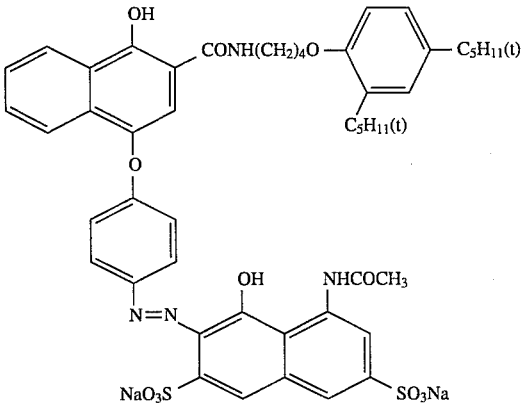
CM-1
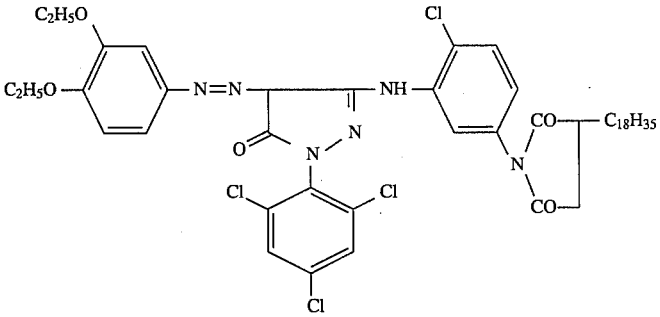

-continued
CM-2
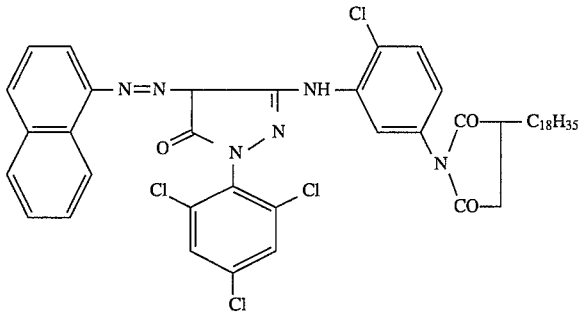
D-1
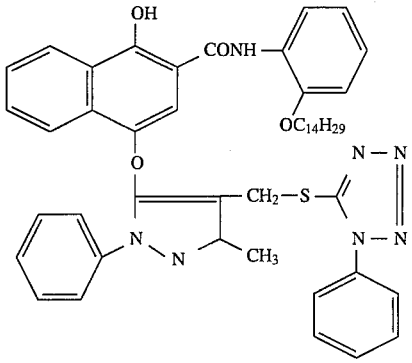
D-2
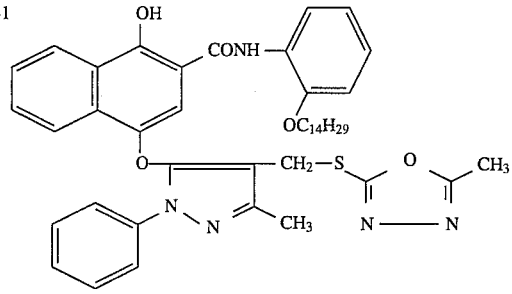
D-3
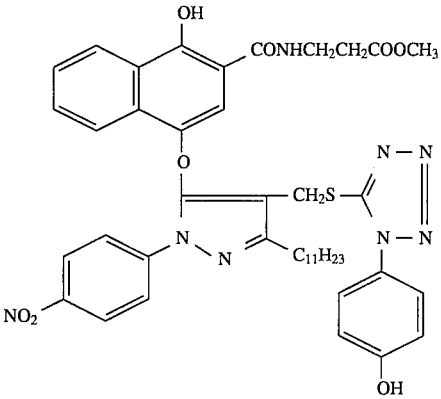
D-4
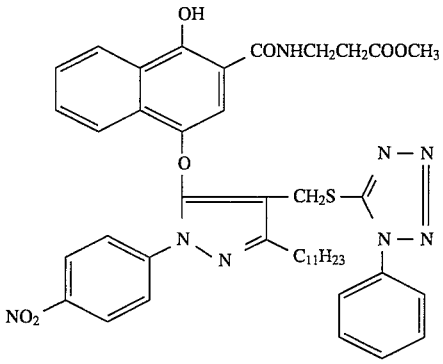
UV-1
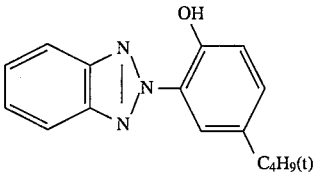
UV-2
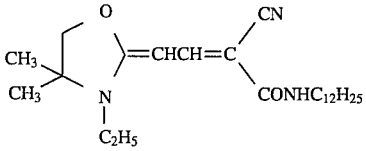
HS-1
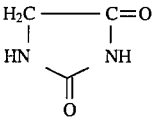
HS-2
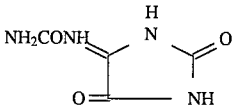
H-1
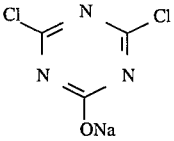
H-2 $[(CH_2{=}CHSO_2CH_2)_3CCH_2SO_2(CH_2)_2]_2N(CH_2)_2SO_3K$
Su-1
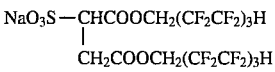
Su-2
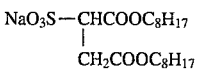

-continued

Su-3

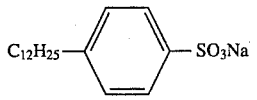

SC-1

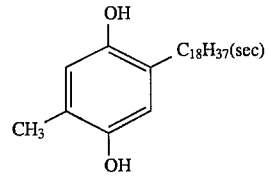

WAX-1

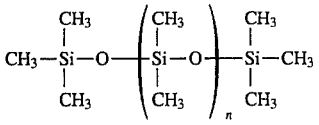

Oil-1

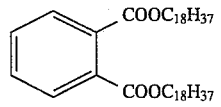

Oil-2

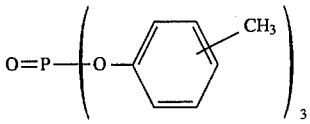

Oil-3

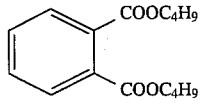

ST-1

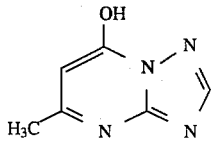

AF-1

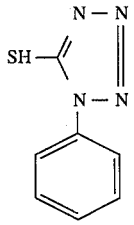

AF-2

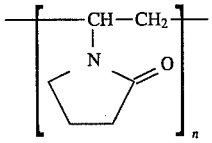

Next, sample Nos. 2 through 9 were prepared in the same manner as for sample No. 1 except that the magenta coupler M-A added to silver halide emulsion layers 6 and 7 was replaced with an equal molar amount of each of the magenta couplers shown in Table 1.

The thus-prepared samples were each subjected to white light exposure through an optical wedge for 0.01 second and then developed by the following process A:

| Process (38° C.) | |
|---|---|
| Color development | 3 minutes 15 seconds |
| Bleaching | 6 minutes 30 seconds |
| Washing | 3 minutes 15 seconds |
| Fixation | 6 minutes 30 seconds |
| Washing | 3 minutes 15 seconds |
| Stabilization | 1 minute 30 seconds |
| Drying | |

The processing solutions used in the respective processes had the following compositions:

| Color developer | |
|---|---|
| 4-amino-3-methyl-N-ethyl-N-(β-hydroxylethyl) aniline sulfate | 4.75 g |
| Anhydrous sodium sulfite | 4.25 g |
| Hydroxylamine ½ sulfate | 2.0 g |
| Anhydrous potassium carbonate | 37.5 g |
| Potassium bromide | 1.3 g |
| Trisodium nitrilotriacetate monohydrate | 2.5 g |
| Potassium hydroxide | 1.0 g |

Water was added to make a total quantity of 11 (pH=10.2).

| Bleacher | |
|---|---|
| Iron (III) ammonium ethylenediaminetetraacetate | 100 g |
| Diammonium ethylenediaminetetraacetate | 10.0 g |
| Ammonium bromide | 150.0 g |
| Glacial acetic acid | 10 ml |

Water was added to make a total quantity of 11, and aqueous ammonia was added to obtain a pH of 6.0.

| Fixer | |
|---|---|
| Ammonium thiosulfate | 175.0 g |
| Anhydrous sodium sulfite | 8.5 g |
| Sodium metasulfite | 2.3 g |

Water was added to make a total quantity of 11, and acetic acid was added to obtain a pH of 6.0.

| Stabilizer | |
|---|---|
| Formalin (37% aqueous solution) | 1.5 ml |
| Konidax (produced by Konica Corporation) | 7.5 ml |

Water was added to make a total quantity of 11.

The thus-obtained dye images from sample Nos. 1 through 28 processed by the above color developing process were evaluated for green-sensitive emulsion layer sensitivity (reciprocal of the exposure amount required to provide a density equivalent to the minimum density plus 0.1), using an optical densitometer (PDA-65 model, produced by Konica Corporation). Figures for relative sensitivity in Table 1 are percent values relative to the sensitivity of sample No. 1.

Next, samples were subjected to uniform white light exposure and processed in the same manner as above. Using these developed samples, printing was conducted to a reflective density of 0.5 gray scale, using printer A, to yield print sample Nos. 1A through 15A. Also, using printer B, which differed from printer A in green band detector spectral sensitivity, printing was conducted with each sample under the same conditions as for printer A to yield print sample Nos. 1B through 15B. With respect to print sample Nos. 1B through 15B, discrepancy from the gray densities in print sample Nos. 1A through 15A, i.e., printer-to-printer fluctuation, was macroscopically evaluated by 10 panelists.

Samples were kept standing under high-temperature high-humidity conditions (50° C. 80% RH) for 3 days after which they were subjected to exposure through an optical wedge and color developing in the same manner as above. The sensitivity of the green-sensitive layer was determined, and the sensitivity difference (ΔlogE) from the samples before storage was calculated.

The results of these evaluations are given in Table 1.

TABLE 1

| Sample No. | Coupler | Layers 6 and 7 Relative sensitivity | Unprocessed storage stability ΔlogE | Printer-to-printer fluctuation | Remark |
|---|---|---|---|---|---|
| 1 | M-A | 100 | −0.07 | D | Comp. |
| 2 | M-B | 99 | −0.06 | D | Comp. |
| 3 | Example Compound 1 | 190 | −0.01 | A | Inv. |
| 4 | Example Compound 2 | 189 | −0.01 | A | Inv. |
| 5 | Example Compound 3 | 175 | −0.02 | A | Inv. |
| 6 | Example Compound 4 | 180 | −0.01 | A | Inv. |
| 7 | Example Compound 5 | 182 | −0.01 | A | Inv. |
| 8 | Example Compound 10 | 151 | −0.02 | A | Inv. |
| 9 | Example Compound 11 | 152 | −0.02 | A | Inv. |

Printer-to-printer fluctuation evaluation criteria
A: Very narrow
B: Narrow
C: Wide
D: Very wide From Table 1, it is seen that sample Nos. 1 and 2, both containing a comparative coupler, had low sensitivity, marked sensitivity reduction under high-temperature high-humidity conditions, and very wide printer-to-printer fluctuation. In contrast, inventive sample Nos. 3 through 9, all incorporating the coupler of the present invention, had high sensitivity, almost no sensitivity reduction under high-temperature high-humidity conditions, and very narrow printer-to-printer fluctuation.

We claim:

1. A silver halide color photographic light-sensitive material comprising a support and a blue-sensitive silver halide emulsion layer, a green-sensitive silver halide emulsion layer and a red-sensitive silver halide emulsion layer, wherein the green-sensitive silver halide emulsion layer contains a coupler of formula M-XI:

M-XI

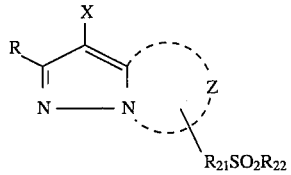

wherein R represents a primary alkyl group having 5 or more carbon atoms; X represents a hydrogen atom or a substituent which splits off upon reaction with the oxidation product of a color developing agent; Z represents a group of non-metal atoms necessary to form a nitrogen-containing heterocyclic ring; R21 represents an alkylene or alkenylene group having a primary carbon bound directly to Z; R22 represents an alkyl group, an alkenyl group, a cycloalkyl group or an aryl group.

2. A silver halide color photographic light-sensitive material according to claim 1, wherein $R_{22}$ represents an alkyl group having 2 to 32 carbon atoms.

3. A silver halide color photographic light-sensitive material according to claim 2, wherein $R_{22}$ represents an alkyl group having 8 to 32 carbon atoms.

4. A silver halide color photographic light-sensitive material according to claims 1, 2 or 3, wherein $R_{22}$ represents a branched alkyl group.

5. A silver halide color photographic light-sensitive material according to claim 1, wherein the magenta coupler is selected from the group consisting of, (1)
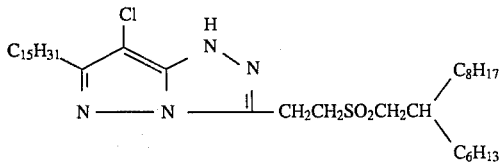
(2)
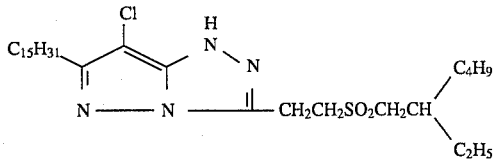
(3)
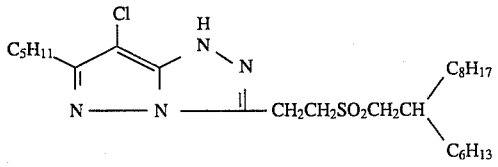
(4)
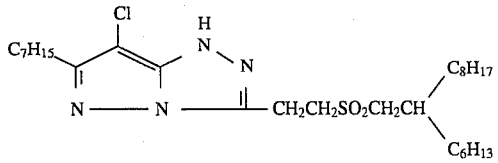
(5)
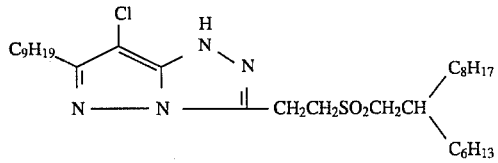
(6)
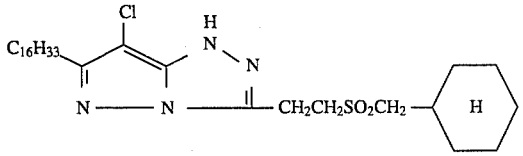
(7)
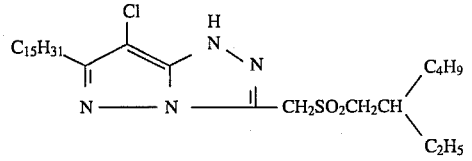
-continued
(8)
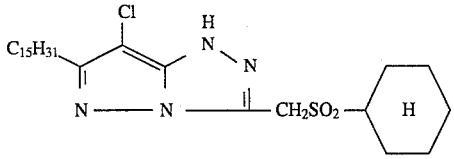
(9)
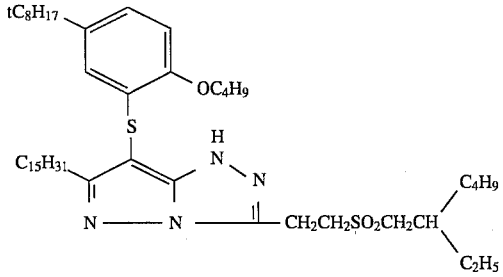
(10)
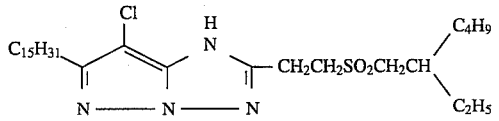
(11)
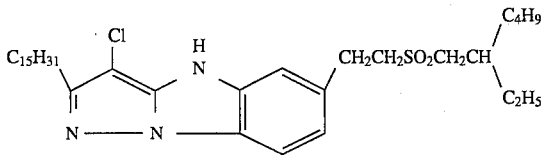
(12)
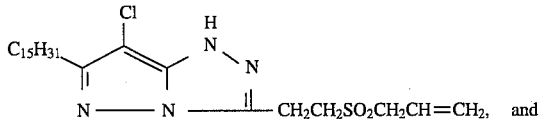
and
(13)
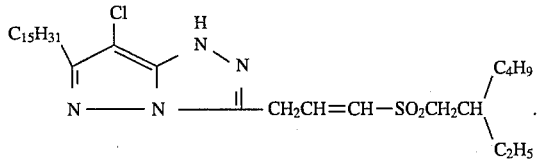
* * * * *